US008420959B2

(12) United States Patent
Burghauser et al.

(10) Patent No.: US 8,420,959 B2
(45) Date of Patent: Apr. 16, 2013

(54) MANUAL DRIVE

(75) Inventors: Armin Burghauser, Regensburg (DE); Silke Wrede, Zeitlarn (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 366 days.

(21) Appl. No.: 12/989,720

(22) PCT Filed: Jul. 23, 2009

(86) PCT No.: PCT/EP2009/005338

§ 371 (c)(1), (2), (4) Date: Nov. 17, 2010

(87) PCT Pub. No.: WO2010/031457

PCT Pub. Date: Mar. 25, 2010

(65) Prior Publication Data

US 2011/0056816 A1 Mar. 10, 2011

(30) Foreign Application Priority Data

Sep. 19, 2008 (DE) ..... 10 2008 048 018

(51) Int. Cl.
*H01H 19/00* (2006.01)

(52) U.S. Cl.
USPC ..... 200/11 TC; 200/17 R; 200/500; 323/328; 323/340

(58) Field of Classification Search ..... 200/1 R, 200/11 R, 11 TC, 17 R, 500, 501, 573, 574, 200/308, 329–331, 336, 337; 74/10.8, 10.9, 74/813 R, 816, 817, 820, 827, 111, 112, 116, 74/117, 640, 412 R, 413, 431, 491; 323/340, 323/341; 307/81, 139, 149; 116/284, 288, 116/293, 296
See application file for complete search history.

(56) References Cited

U.S. PATENT DOCUMENTS

| | | | | |
|---|---|---|---|---|
| 2,693,573 | A * | 11/1954 | Perkins | 323/341 |
| 3,427,530 | A * | 2/1969 | Hartwell et al. | 323/256 |
| 4,225,615 | A | 9/1980 | Grantham | |
| 6,234,106 | B1 * | 5/2001 | Dohnal et al. | 116/284 |
| 6,307,283 | B1 * | 10/2001 | Dohnal et al. | 307/139 |
| 7,343,873 | B2 * | 3/2008 | Hernandez et al. | 116/300 |
| 7,750,257 | B2 * | 7/2010 | Lindsey et al. | 200/11 TC |
| 7,977,588 | B2 * | 7/2011 | Chandler | 200/11 TC |
| 2009/0000927 | A1 * | 1/2009 | Albrecht et al. | 200/11 TC |
| 2009/0071806 | A1 * | 3/2009 | Xiao | 200/11 TC |

FOREIGN PATENT DOCUMENTS

| | | | |
|---|---|---|---|
| DE | 29923481 | U | 12/2000 |
| GB | 1294189 | B | 10/1972 |

* cited by examiner

*Primary Examiner* — Michael Friedhofer
(74) *Attorney, Agent, or Firm* — Andrew Wilford

(57) ABSTRACT

The invention relates to a manual drive for step-by-step operation, without any power, of a tap changer (1) on a tap-changing transformer. The manual drive has a position indication wheel (4) which is used not only, in conjunction with a pointer (15), for actual position indication, but at the same time as a component of mechanical final-position limiting (10, 11, 12). It can also furthermore be used (18) in a particularly advantageous manner as a component of electrical switching monitoring.

2 Claims, 6 Drawing Sheets

MANUAL DRIVE

CROSS REFERENCE TO RELATED APPLICATIONS

This application is the US national phase of PCT application PCT/EP2009/005338, filed 23 Jul. 2009, published 25 Mar. 2010 as WO 2010/031457, and claiming the priority of German patent application 10 2008 048 018.5 itself filed 19 Sep. 2008, whose entire disclosures are herewith incorporated by reference.

The invention relates to a manual drive for stepped power-free actuation of a tap changer at a tapped transformer.

Such a manual drive is already known from the applicant's publication "Handantrieb MR 404." It comprises a load transmission for an insertable hand crank as well as a control transmission for a setting indicator and a drive blocking device. The setting indicator is in that case realized by a numerical disk located behind an inspection glass and readable from outside. The control transmission has in this known manual drive an own transmission group exclusively for this setting indicator, consisting of a Geneva crank of a cam wheel, a Geneva wheel, four gears following thereon and finally the mentioned numerical disk.

It will be obvious that such a setting indication by is numerous necessary transmission components of that kind is inordinately complicated. A further disadvantage of the known manual drive is that there is no provision of a mechanical end setting limitation that prevents overtravel of the respective end position of the tap changer, which is to be actuated, by mechanical means not just in the tap changer itself, but already in the manual drive.

It is accordingly the object of the invention to indicate a manual drive of the kind stated in the introduction which has a simple and easily perceivable setting indication on the one hand and a simple mechanical, but reliable, end setting limitation on the other hand.

This object is fulfilled by a manual drive with the features of the first patent claim. The dependent claims relate to advantageous developments of the invention.

The general inventive concept is based on the fact of using components, which are necessary anyway, of an improved and optically more easily perceptible setting indication at the same time for a mechanical end setting limitation. This reduces the number of components required. A further advantage of the invention consists in that this end setting limitation can be adapted in simple manner to different total setting numbers of the manual drive.

A setting indication of a motor drive for actuation of an on-load tap changer, which has two scales on an indicator plate, is known from WO 1998/038662 [U.S. Pat. No. 6,234,106]. Arranged on the first scale are symbols, with which are associated the individual switching steps which are run through when switching over from one operational setting to another, adjacent operational setting of the on-load tap changer. This first scale is swept by a first pointer. In addition, a second scale is provided on which are arranged symbols associated with the individual operating settings. This scale cooperates with a second pointer, which rotates, on each occasion of a switching over, through the angle between two adjacent operational setting symbols. Provided below the indicator plate is an indicator transmission that is constructed in such a manner that with each switching over the first pointer is rotated through 360 degrees in dependence on the rotational direction and the second pointer is rotated through the described angle between two adjacent symbols on the second scale in dependence on rotational direction.

In the case of the invention this setting indication, which is known for motor drives of on-load tap changers, is modified for a manual drive of a tap changer and developed by additional means for mechanical end setting limitation. A reduction in components and an overall simpler construction of the manual drive are thus possible in particularly advantageous manner.

The invention will be explained in more detail by way of example in the following on the basis of drawings, in which.

Figure 1:
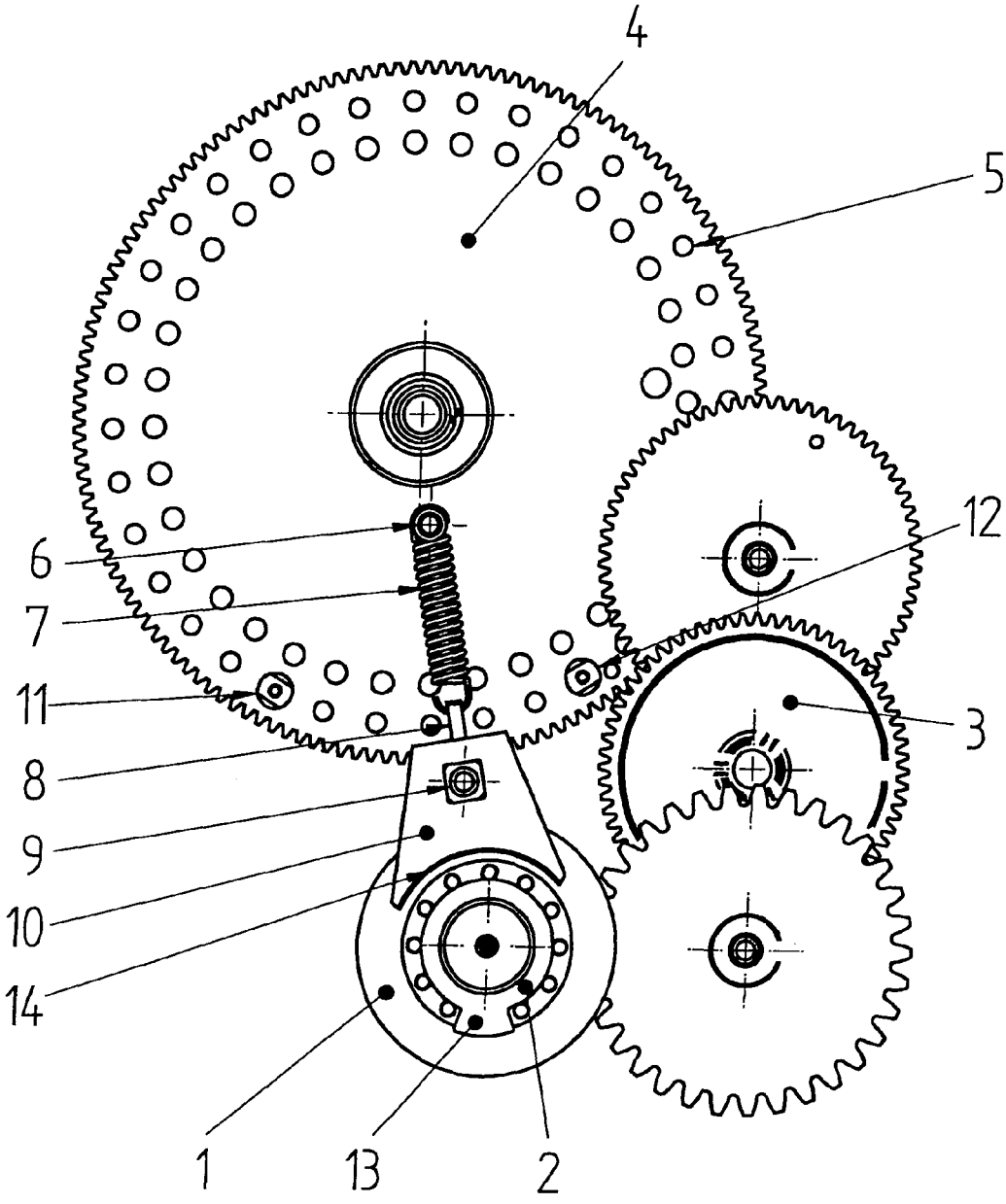
FIG. 1 shows a part of the manual drive with an end setting blocking means.

The construction, which is illustrated in FIG. 1, of the end setting blocking means according to the invention of a manual drive shall initially be explained in more detail. The manual drive comprises a hand shaft 1 that can be rotated by an insertable hand crank (not illustrated). In that case, here eight revolutions of the hand crank and thus of the hand shaft 1 correspond with a complete switching over. An end abutment 2, which will be explained in more detail later, is fixedly connected with the hand shaft 1. The hand shaft 1 acts on an indicator transmission 3 and this in turn on a setting indicator wheel 4. The indicator transmission 3 is so dimensioned that for each complete actuation of the manual drive, i.e. switching over between two adjacent positions of the associated tap changer, the setting indicator wheel 4 rotates through a defined angle. This angle corresponds with the spacing between two adjacent setting symbols on an indicator plate (not illustrated). The setting symbols are swept by a pointer that is fixedly connected with the setting indicator wheel 4, but is not illustrated here. The respective actual operational setting is thus indicated by the pointer, as is already known from WO 98/38662. Disposed on a concentric circle on the setting indicator wheel 4 are, in addition, seat bores 5 that are arranged relative to one another at the same angle, which corresponds with the rotational angle of the setting indicator wheel 4 and thus of the pointer, which is connected therewith, in each switching over. Moreover, disposed in the manual drive at a mount (not illustrated) is a fixed spring suspension 6 at which a spring 7 is pivoted. The spring 7 is pivoted at a further free end to a trigger plate 8, which in turn acts on a rotatable blocking fork shaft 9 to which a blocking fork 10 is fastened to be secure against relative rotation. Also shown in FIG. 1 are two trigger pins 11, 12 that correspond with the end settings able to be attained by the manual drive. The trigger plate 8 is so arranged that it is hit by the trigger pins 11, 12 moved past and is laterally deflected depending on the respective rotational direction of the impinging trigger pin 11 or 12. The end abutment 2 has an end abutment profile 13, which will be explained in more detail further below. The blocking fork 10 for its part has a blocking profile 14 co-operating with the end abutment profile 13.

The rotation of the hand shaft 1 accordingly produces a rotation of the setting indicator wheel 4. In that case, as explained, the rotational movement of the hand shaft 1 is reduced by way of an indicator transmission 3 to a desired rotational angle per switching. This rotational angle per switching is translated by way of the pointer, which is connected with the setting indicator wheel 4, into an indication of the actual operational setting in which the tap changer is just disposed. For that purpose the pointer wipes a stationary scale as is already known from WO 98/38662. The seat bores 5 serving for reception of the trigger pins 11 for the end setting blocking means are, as explained, arranged at these rotational angle spacings. It is thereby possible to derive from the trigger pin 11 appropriate data that are correlated with the respective operational setting of the tap changer. In the case of the invention these trigger pins 11 are used for determining the end setting. For that purpose those ones of the seat bores 5 that correspond with an operational setting that is exactly one setting more than the last possible operational setting of the tap changer are provided with corresponding trigger pins 11, 12. In other words: the trigger pins 11, 12 are so positioned that they are disposed at the two angle regions to the left and right of the respective switchable end positions of the respective tap changer and thus bound the switching region on both sides. The number of possible settings of the tap changer and thus the positioning of the trigger pins 11, 12 depends on the respective mode of construction of the tap changer. Through the arrangement of seat bores 5 at the respective angle spacing on a concentric, complete circle on the setting wheel 5 an adaptation of the manual drive to the respective tap changer, with which it is to cooperate, as well as the possible number of settings thereof is provided in simple manner.

Figure 2:
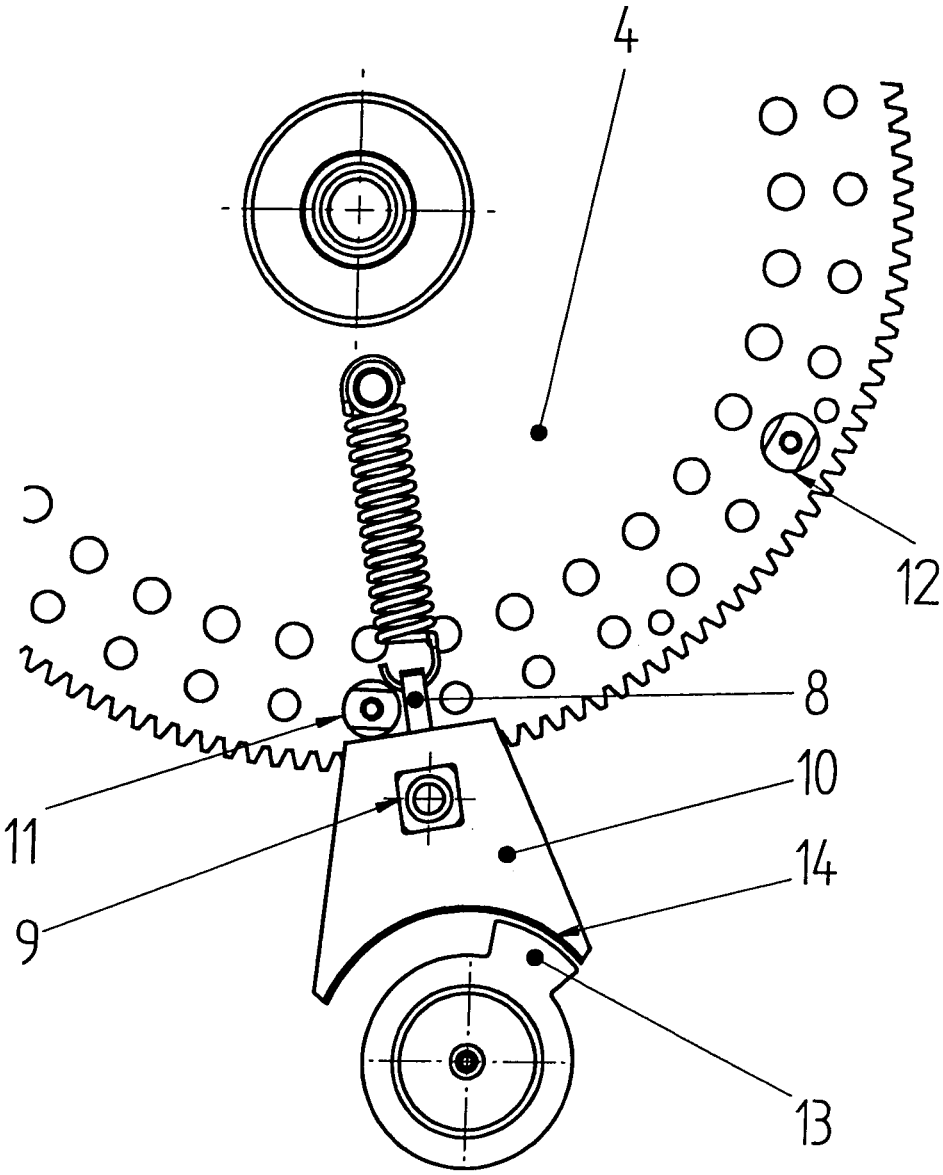
FIGS. 2 to 4 show different settings of the end setting blocking means on reaching an end position of the manual drive.

FIG. 2 shows the last possible operational setting of the tap changer. In this setting the end setting blocking means is disposed in the illustrated position. The blocking fork 10 is still in neutral position, in which it is fixed by the spring 7; the trigger pin 11 does not contact the trigger plate 8.

Figure 3:
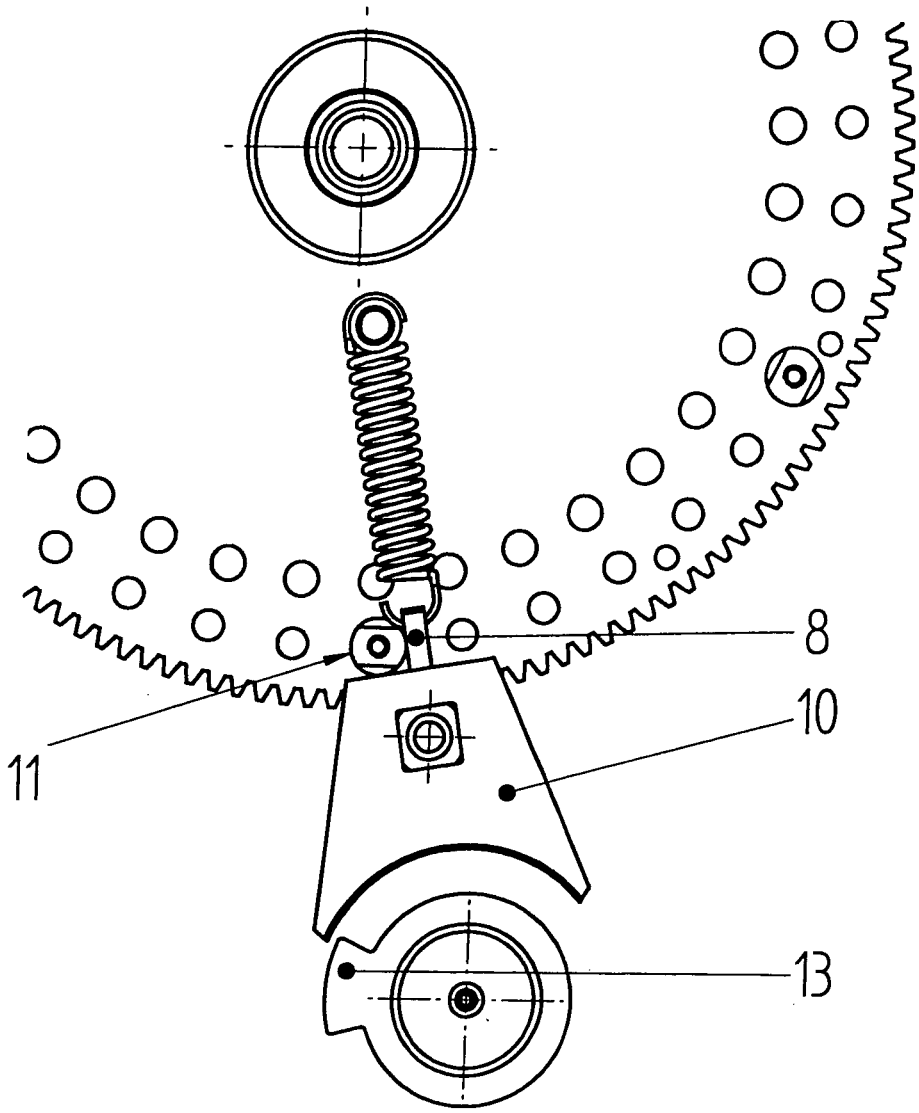

FIG. 3 shows the end setting limitation in a position in which it is sought to switch beyond the last possible position, i.e. the end setting. The state in the case of half a rotation of the hand crank is shown here; this corresponds with 1/16 of a switching. It can be seen that the trigger pin 11 now contacts the trigger plate 8. The blocking fork 10 is thus deflected out of its neutral position to the left against the force of the spring 7. In this position the end abutment 2 can still just move past the blocking fork 10.

Figure 4:
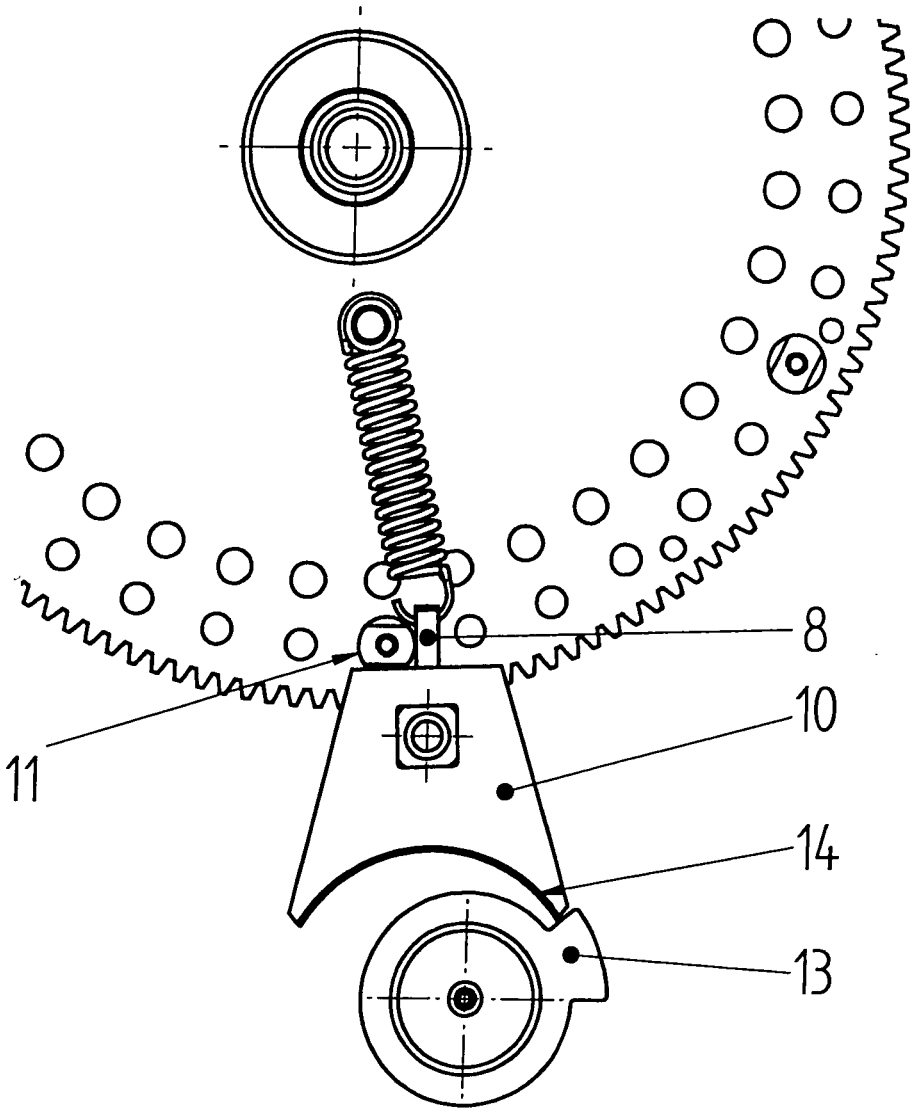

FIG. 4 shows the situation with progressive further rotation beyond the last possible end setting, here at 1 and 1/4 hand crank rotation, which corresponds with 5/32 of a switching. The trigger pin 11 now presses the trigger plate 8 and thus the blocking fork 10 to the left still further out of the neutral position thereof. The end abutment 2 thus, by its end abutment profile 13, no longer passes the blocking fork 10. The end setting blocking means is active; due to the mechanically positive locking of the blocking fork 10 by the end abutment profile 13 of the end abutment 2 a further rotation in this direction is not possible. Only through rotation of the hand crank in the opposite direction, thus out of the end setting of the tap changer into the normal switching range thereof, is an automatic unblocking of the manual drive possible.

Figure 5:
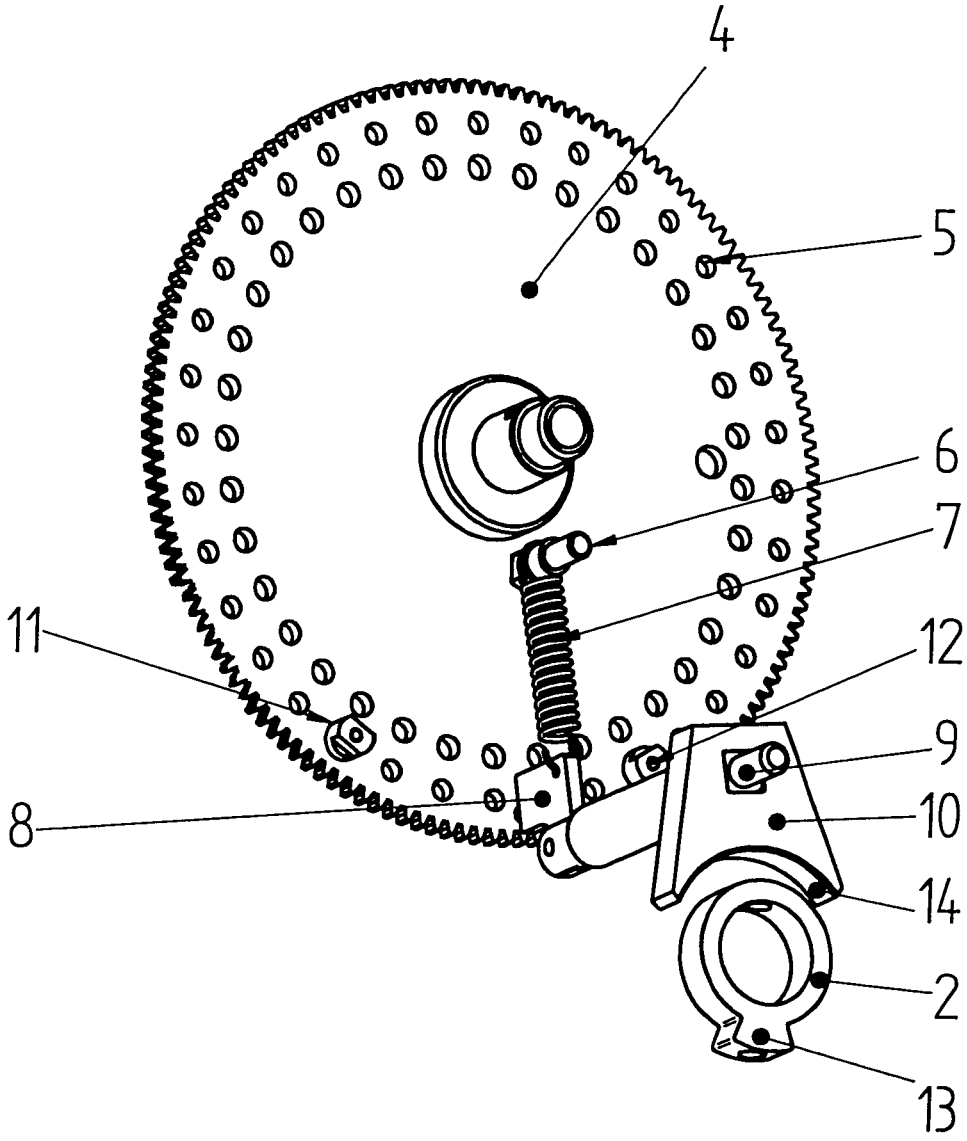
FIG. 5 shows important components of the end setting blocking means in schematic perspective illustration and FIG. 6 shows a part of the manual drive according to the invention from the opposite side as seen with respect to FIG. 5, similarly in schematic perspective illustration.

FIG. 5 shows once more in schematic illustration the cooperation of the trigger pins 11, 12 of the blocking plate 8 with the fixedly connected blocking fork 10 with its blocking profile 14 and of the end abutment 2 with its end abutment profile 13.

Figure 6:
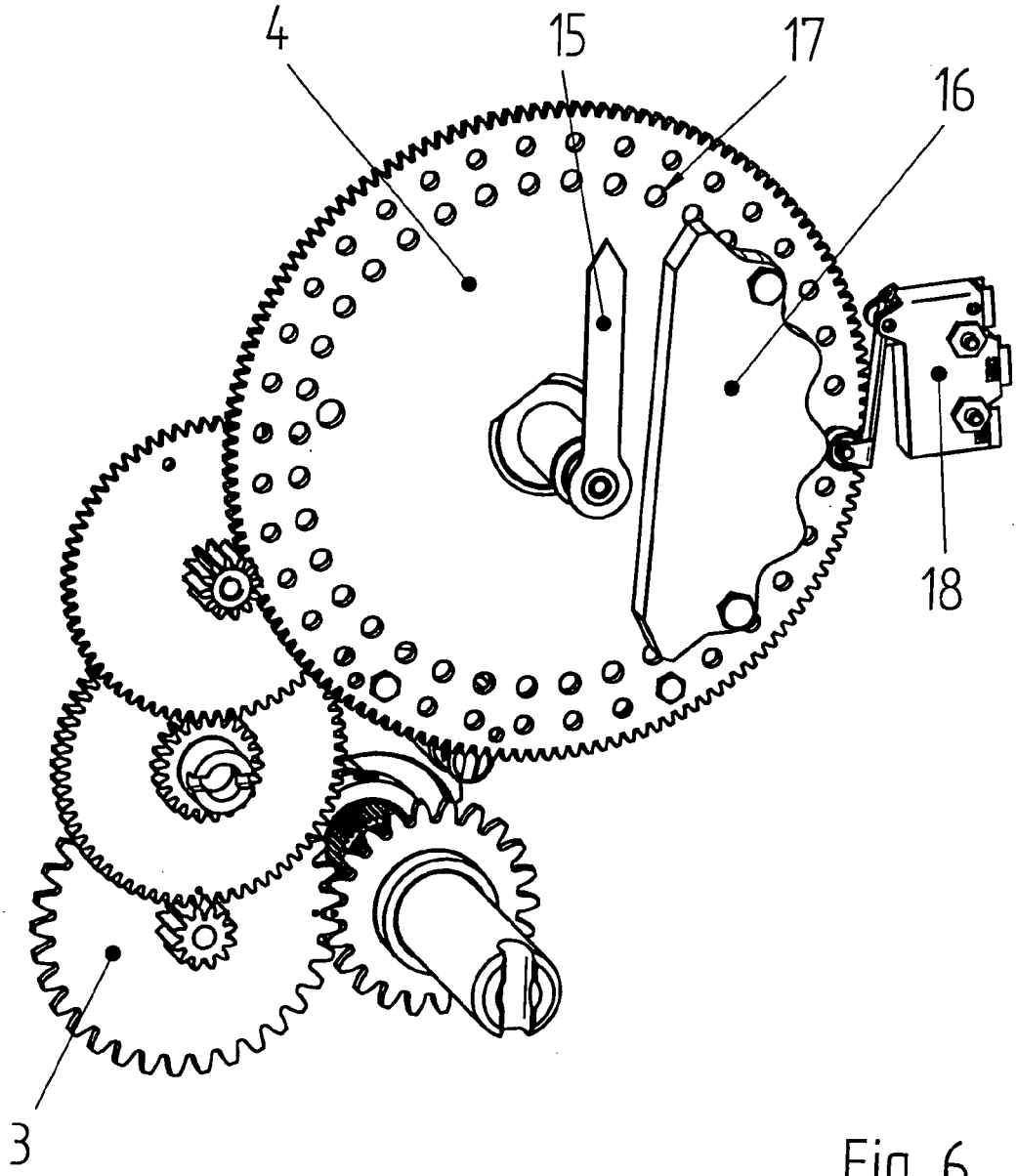

FIG. 6 shows the manual drive of the invention from the other side, similarly in perspective illustration. The pointer 15, is which was already mentioned earlier and which is fixedly connected with the setting indicator wheel 4, is illustrated again here. The indicator plate, which lies below the pointer 15, with the individual symbols that correspond with the possible operational settings and that can be swept, is not illustrated. It is important—this was already explained further above—that the pointer 15 rotates, with each switching over, through a defined angle corresponding with the spacing between two adjacent setting symbols. In a particularly advantageous development of the invention a switch monitoring segment 16 is provided, which is fastened in further seat bores 17 on a further pitch circle of the setting indicator wheel 4. The end of the switch monitoring segment 16 carries cams having the same pitch as the indicator symbols. These cams cooperate in a manner known per se with an electrical switch 18 and serve together therewith for electrical switch monitoring.

Analogously to the selectable positioning of the trigger pins 11, 12 depending on the actual constructional form of the tap changer to be actuated the switch monitoring segment is also to be flexibly arranged in that manner. The positioning of the switch monitoring segment 16 is also dependent on the tap number of the tap changer. It is in that case dimensioned so that for each possible switch setting a characteristic part profile, i.e. a cam or a cam valley, is provided on the end.

Overall, the manual drive according to the invention offers a number of advantages. A setting indicator wheel 4 is present, which in a manner already known from on-load tap changers serves for optically readily perceptible setting indication by means of a pointer 15. This setting indicator wheel 4 is in the case of the invention also used at the same time as a component of the mechanical end setting limitation. In particularly advantageous manner it can also be used as a component of the electrical switch monitoring. Multiple use of the setting indicator wheel 4 is thus provided; this gives a simple construction with few components. Moreover, a simple adaptation of all functions to the corresponding tap changer, which is to be actuated, is possible. This adaptation concerns not only the number of possible switch settings of the tap changer, but also the number of required revolutions of the hand crank for one switching over. Finally, an equally simple adaptation to different pitches of the setting indication is also possible, i.e. different angle spacings between adjacent setting symbols.

REFERENCE NUMERAL LIST

1 hand shaft
2 end abutment
3 indicator transmission
4 setting indicator wheel
5 seat bore
6 spring suspension
7 spring
8 trigger plate
9 blocking fork shaft
10 blocking fork
11 trigger pin
12 trigger pin
13 end abutment profile
14 blocking profile
15 pointer
16 switch monitoring segment
17 bores
18 electrical switch

The invention claimed is:

1. In a manual drive for stepped, power-free actuation of a tap changer at a tapped transformer, wherein an insertable hand crank engages in a hand shaft and acts on a load transmission for actuation of the tap changer as well as an indicator transmission connected with a setting indicator, the improvement wherein the indicator transmission (3) comprises a setting indicator wheel, the indicator transmission is so dimensioned that, with each complete actuation of the manual drive switching between two adjacent positions of the tap changer, the setting indicator wheel rotates through a defined angle, the manual drive further comprises a fixed spring suspension at which a spring is pivoted, the spring being pivoted at its other free end to a trigger plate which in turn acts on a rotatable blocking fork shaft to which a blocking fork is fastened, the trigger plate is so arranged that it is hit by trigger pins located on the setting indicator wheel as the trigger pins are moved past and is laterally deflected, the hand shaft has a mechanical end abutment, the deflectable blocking fork so cooperates with the end abutment that the blocking fork in deflected state on reaching an end setting mechanically engages in the end abutment, a pointer co-operating with a scale is fixedly arranged at the setting indicator wheel, the setting indicator wheel has on a concentric circle seat bores for reception of the trigger pins that are arranged relative to one another at an angle corresponding with the rotational angle of the setting indicator wheel for a switching over, and the trigger pins are so detachably securable at selected bores of the setting indicator wheel that the manual drive is adaptable to different numbers of possible switch settings of the tap changer and to different revolution numbers of the hand crank for one switching over.

2. The manual drive according to claim 1, wherein the setting indicator wheel has, on a further concentric circle, further seat bores having the same pitch as the bores for the trigger pins and that fastened in the seat bores is a switch monitoring segment having cams that cooperate with at least one electrical switch.

* * * * *